US007300008B2

(12) United States Patent
Gingras

(10) Patent No.: US 7,300,008 B2
(45) Date of Patent: Nov. 27, 2007

(54) TOOTH REFINER PLATES WITH VARYING FEEDING ANGLES AND REFINING METHOD

(75) Inventor: Luc Gingras, Lake Oswego, OR (US)

(73) Assignee: Andritz Inc., Glens Falls, NY (US)

( * ) Notice: Subject to any disclaimer, the term of this patent is extended or adjusted under 35 U.S.C. 154(b) by 0 days.

(21) Appl. No.: 11/357,415

(22) Filed: Feb. 21, 2006

(65) Prior Publication Data

US 2007/0158484 A1 Jul. 12, 2007

Related U.S. Application Data

(60) Provisional application No. 60/743,107, filed on Jan. 9, 2006.

(51) Int. Cl.
*B02C 7/04* (2006.01)

(52) U.S. Cl. ..... 241/261.3; 241/298

(58) Field of Classification Search ..... 241/261.2, 241/261.3, 296, 298, 297
See application file for complete search history.

(56) References Cited

U.S. PATENT DOCUMENTS 1,595,282 A * 8/1926 Bauer ..... 241/296
5,244,159 A * 9/1993 Newnan ..... 241/261.3
5,362,003 A * 11/1994 Virving ..... 241/261.3
5,383,617 A * 1/1995 Deuchars ..... 241/298
5,683,048 A * 11/1997 Virving ..... 241/261.2

* cited by examiner

*Primary Examiner*—Faye Francis
(74) *Attorney, Agent, or Firm*—Nixon & Vanderhye P.C.

(57) ABSTRACT

A refiner plate including: concentric rows of teeth and the teeth arranged facing radially inward, the sidewalls of the teeth are at an angles to radii of the plate such that the angle of teeth in a first row(s) of teeth differs from the angle of teeth in a second row(s) of teeth.

24 Claims, 7 Drawing Sheets

TOOTH REFINER PLATES WITH VARYING FEEDING ANGLES AND REFINING METHOD

The benefit is claimed of U.S. Provisional Application Ser. No. 60/743,107, filed Jan. 9, 2006, which application is incorporated in its entirety by reference.

BACKGROUND OF THE INVENTION

This invention relates generally to refiners for removing contaminants from fiber materials, such as recycled or recovered paper and packaging materials. In particular, the present invention relates to refiner plates and especially to the angular alignment of teeth on the plate.

Refiner plates are used for imparting mechanical work on fibrous material. Refiner plates having teeth (in contrast to plates having bars) are typically used in refiners which serve to deflake, disperge or mix fibrous materials with or without addition of chemicals. The refiner plates disclosed herein are generally applicable to all toothed plates for dispergers specifically and refiners in general.

Disperging is primarily used in de-inking systems to recover used paper and board for reuse as raw material for producing new paper or board. Disperging is used to detach ink from fiber, disperse and reduce ink and dirt particles to a favorable size for downstream removal, and reduce particles to sizes below visible detection. The disperger is also used to break down stickies, coating particles and wax (collectively referred to as "particles") that are often in the fibrous material fed to refiner. The particles are removed from the fibers by the disperger become entrained in a suspension of fibrous material and liquid flowing through the refiner, and are removed from the suspension as the particles float or are washed out of the suspension. In addition, the disperger may be used to mechanically treat fibers to retain or improve fiber strength and mix bleaching chemicals with fibrous pulp.

There are typically two types of mechanical dispergers used on recycled fibrous material: kneeders and rotating discs. This disclosure focuses on disc-typed disperger plates that have toothed refiner stator plates. Disc-type dispergers are similar to pulp and chip refiners. A refiner disc typically has mounted thereon an annular plate or an array of plate segments arranged as a circular disc. In a disc-type disperger, pulp is fed to the center of the refiner using a feed screw and moves peripherally through the disperging zone, which is a gap between the rotating (rotor) disk and stationary (stator) disk, and the pulp is ejected from the disperging zone at the periphery of the discs.

The general configuration of a disc-type disperger is two circular discs facing each other with one disc (rotor) being rotated at speeds usually up to 1800 ppm, and potentially higher speeds. The other disc is stationary (stator). Alternatively, both discs may rotate in opposite directions.

On the face of each disc is mounted a plate having teeth (also referred to as pyramids) mounted in tangential rows. A plate may be a single annular plate or an annular array of plate segments. Each row of teeth is typically at a common radius from the center of the disc. The rows of rotor and stator teeth interleave when the rotor and stator discs are opposite each other in the refiner or disperger. The rows of rotor and stator teeth intersect a plane in the disperging zone that is between the discs. Channels are formed between the interleaved rows of teeth. The channels define the disperging zone between the discs.

The fibrous pulp flows alternatively between rotor and stator teeth as the pulp moves through successive rows of rotor and stator teeth. The pulp moves from the center inlet of the disc to a peripheral outlet at the outer circumference of the discs. As fibers pass from rotor teeth to stator teeth and vice-versa, the fibers are impacted as the rows of rotor teeth rotate between rows of stator teeth. The clearance between rotor and stator teeth is typically on the order of 1 to 12 mm (millimeters). The fibers are not cut by the impacts of the teeth, but are severely and alternately flexed. The impacts received by the fiber break the ink and toner particles off of the fiber and into smaller particles, and break the stickie particles off of the fibers.

Two types of plates are commonly used in disc-type dispergers: (1) a pyramidal design (also referred to as a tooth design) having an intermeshing toothed pattern, and (2) a refiner bar design. A novel pyramidal tooth design has been developed for a refiner plate and is disclosed herein.

An enhanced exemplary pyramidal toothed plate segment is shown in commonly-owned U.S. Patent Application Publication No. 2005/0194482, entitled "Grooved Pyramid Disperger Plate." For pyramidal plates, fiber stock is forced radially through small channels created between the teeth on opposite plates, as shown in FIG. 1*c*. Pulp fibers experience high shear, e.g., impacts, in their passage through dispergers caused by intense fiber-to-fiber and fiber-to-plate friction.

FIGS. 1*a*, 1*b* and 1*c* show an exemplary pyramidal plate segment having a conventional tooth pattern. The refiner or disperger 10 comprises disperger plates 14, 15 which are each securable to the face of one of the opposing disperger discs 12, 13. The discs 12, 13, only portions of which are shown in FIG. 1*c*, each have a center axis 19 about which they rotate, radii 32 and substantially circular peripheries.

A plate may or may not be segmented. A segmented plate is an annular array of plate segments typically mounted on a disperger disc. A non-segmented plate is a one-piece annular plate attached to a disperger disc. Plate segment 14 is for the rotor disc 12 and plate segment 15 is for the stator disc 13. The rotor plate segments 14 are attached to the face of rotor disc 12 in an annular array to form a plate. The segments may be fastened to the disc by any convenient or conventional manner, such as by bolts (not shown) passing through bores 17. The disperger plate segments 14, 15 are arranged side-by-side to form plates attached to the face of the each disc 12, 13.

Each disperger plate segment 14, 15 has an inner edge 22 towards the center 19 of its attached disc and an outer edge 24 near the periphery of its disc. Each plate segment 14, 15 has on its substrate face concentric rows 26 of pyramids or teeth 28. The rotation of the rotor disc 12 and its plate segments 14 apply a centrifugal force to the refined material, e.g., fibers, that cause the material to move radially outward from the inner edge 22 to the outer edge 24 of the plates. The refined material predominantly move through the disperging zone channels 30 formed between adjacent teeth 28 of the opposing plate segments 14, 15. The refined material flows radially out from the disperging zone into a casing 31 of the refiner 10.

The concentric rows 26 are each at a common radial distance (see radii 32) from the disc center 19 and arranged to intermesh so as to allow the rotor and stator teeth 28 to intersect the plane between the discs. Fiber passing from the center of the stator to the periphery of the discs receive impacts as the rotor teeth 28 pass close to the stator teeth 28. The channel clearance between the rotor teeth 28 and the stator teeth 28 is on the order of 1 to 12 mm so that the fibers are not cut or pinched, but are severely and alternately flexed as they pass in the channels between the teeth on the rotor disc 12 and the teeth on the stator disc 13. Flexing the fiber breaks the ink and toner particles on the fibers into smaller particles and breaks off the stickie particles on the fibers.

FIGS. 2*a* and 2*b* show a top view and a side cross-sectional view, respectively, of a standard tooth geometry 34 used in the outer row of a stator plate. The tooth 34 has a pyramidal design consisting of straight sides 36 that taper to the top 38 of the tooth. The sides of the standard tooth 28 are each substantially parallel to a radial 32 of the plate.

A prior art plate exists wherein the first three to four rows of teeth each have approximately a 10 degree feed angle, and the outermost three to four rows of teeth have a 0 degree feed angle. In addition, other prior art plates include rows of feeding bars (which are a type of teeth) that have a slight increasing feeding angle from row to row, until the feed angle reaches zero (0) degrees wherein the remaining outer rows retain the zero degree feed angle. A typical plate with increasing feed angles, has an arrangement of feeding angles (beginning with the radially innermost feeding bar row) of: $10^0$, $11^0$, $12^0$, $13^0$, $0^0$, $0^0$, $0^0$, and $0^0$.

A primary role of the disperger plate is to transfer energy pulses (impacts) to the fibers during their passage through the channels between the discs. The widely accepted toothed plate typically includes the square pyramidal tooth geometry with variations in edge length and tooth placement to achieve desired results.

Refiner material passing between the discs can be accelerated to a high velocity due to the centrifugal forces imparted by the rotor disc. Some of the refiner material exits the discs 12, 13 at a high velocity and are flung radially against the refiner casing 31. The high velocity impacts of refiner material against the casing have caused abrasive wear and damaging cavitation to the casing. There is a long felt need for a means to reduce the wear and damage on refiner and disperger casing due and, particularly, to reduce the wear and damage caused by refiner material impacts against the casing.

BRIEF DESCRIPTION OF THE INVENTION

A refining plate has been developed having teeth with a feed angle that varies across the rows of the plate. The plate may be for a refiner and in particular for a disperger. The plate may be for a stator disc or a rotor disc, or for a pair of rotor discs.

In particular, a tooth disperger plate has been developed that has rows of teeth feeding angles where: the feed angle varies from the innermost row of teeth to the outermost row of teeth, and the variance in the feeding angles across the rows in 15 to 90 degrees, preferably 20 to 90 degrees and more preferably 30 to 90 degrees. The feed angle may change from row to row. Alternatively, the feed angle across a plurality of rows, e.g., 2 to 3, may be a first constant feed angle; the feed angle across a second plurality of rows may be a second feed angle (lesser than the first) and a feed angle across a third and last group of rows may be a third angle (lesser than the second). Further the feed angle of the first row of teeth (or first few rows of teeth) may vary by 15 to 90 degrees (and preferably by 20 to 90 degrees) with respect to the feed angle of the outermost teeth row (or last few rows of teeth). The variances in the feed angles may be applied to reduce the feed angle in the radially outward rows, increase the holdback angle of the outer rows, and change the function of the feed back angle from feeding pulp into the disperger zone (at the inner rows) to holding back pulp within the zone (at the outer rows).

A refiner plate has been developed comprising: concentric rows of teeth and the teeth are arranged facing radially inward, the sidewalls of the teeth are at an angles to radii of the plate such that the angle of a first row of teeth differs from the angle of a second row of teeth. The refiner plate may be for a disperger.

A refiner plate has been developed comprising: concentric rows of teeth; a feed angle formed on each tooth, wherein the feed angle is formed by a leading edge of the tooth; a feed angle for a first row of teeth differs from a second feed angle for a second row of teeth, wherein the difference between feed angles is in a range of 15 to 90 degrees. The difference may be in a range of 20 to 90 degrees, or more narrowly in a range of 30 to 90 degrees. The first row of teeth may a radially innermost row of teeth and the second row of teeth a radially outermost row of teeth.

Further, the first row of teeth may form an angle in a range of 5 degrees to minus 5 degrees with respect to radial lines of the plate, or a holdback angle in a range of minus 5 degrees to minus 30 degrees with respect to radial lines of the plate. A holdback angle is a feedback angle that is typically express in minus degrees. Moreover, the inlet angle may be neutral, e.g., zero degrees with respect to a radial, and angles of the teeth turning from neutral to holdback angles as the rows progress radially outward. Alternatively, the inlet row of teeth may have a slight holdback angle and the holdback angle increases from row to row in a radial outward direction. Further, the inlet row may have a feeding angle and the tooth angle turns to a holdback angle at the radially outward rows. In another embodiment, the inlet row may be at a strong feed angle and the tooth angle turns to a slight feed angle or a neutral angle towards the radial outward rows.

In the refiner plate, the feed angle may vary from row to row, and the difference is a cumulative difference across the rows of teeth on the plate. The feed angles between adjacent rows of teeth may vary between 3 degrees and 5 degrees for all rows on the plate.

Alternatively, the a first group of rows of teeth have the same feed angle as does the first row, a second group of rows of teeth have the same feed angle as does the second row, and a third group of rows of teeth have a third feed angle, wherein the third feed angle is intermediate the first and second feed angles. The first group of rows may be radially inward of the third group, and the third group radially inward of the second group.

A refiner comprising: a rotor disc including a rotor plate and a stator disc including a stator plate wherein the stator plate is opposite to and faces the rotating rotor plate; the rotor plate includes concentric rows of teeth, a feed angle for a first row of teeth of the rotor plate differs from a second feed angle for a second row of teeth, wherein the difference between feed angles is in a range of 15 to 90 degrees, and the stator plate includes concentric rows of teeth, a feed angle for a first row of teeth of the stator plate differs from a second feed angle for a second row of teeth, wherein the difference between feed angles is in a range of 15 to 90 degrees.

A method for refining material between opposing discs in a refiner has been developed comprising: feeding the material to an inlet of at least one of the discs; rotating one disc with respect to the other disc while the material moves radially outward between the discs, and subjecting the material to impacts caused by rows of teeth on the rotating disc intermeshing with rows of teeth on the other disc, wherein a feed angle for a first row of teeth on at least one of said disc differs from a second feed angle for a second row of teeth on said at least one of said disc and the difference between feed angles is in a range of 15 to 90 degrees.

BRIEF DESCRIPTION OF THE DRAWINGS

FIG. 1(*c*) is a side partial cross-sectional view of a stator and rotor disperger plates and discs with a channel therebetween.

DETAILED DESCRIPTION OF THE INVENTION

The novel refiner plate disclosed herein is applicable to any type of disperger and to pyramidal or tooth refiner plates. A feature of the plate is a novel geometry of the rows of teeth located on the rotor and stator plates. The novel tooth geometry relates to orienting the sides of a tooth such that the side forms an angle with respect to a radius of the plate or disc. The plates include a novel rotor plate design (to be applied to the rotating disc) and a novel stator plate design (to be applied to the fixed—non-rotating—disc). These novel plate designs relate to the pattern of teeth rows, wherein each row of teeth have a generally common angle between the sides of the teeth and a radius, and wherein the sidewall angle changes from row to row.

Figure 1A:
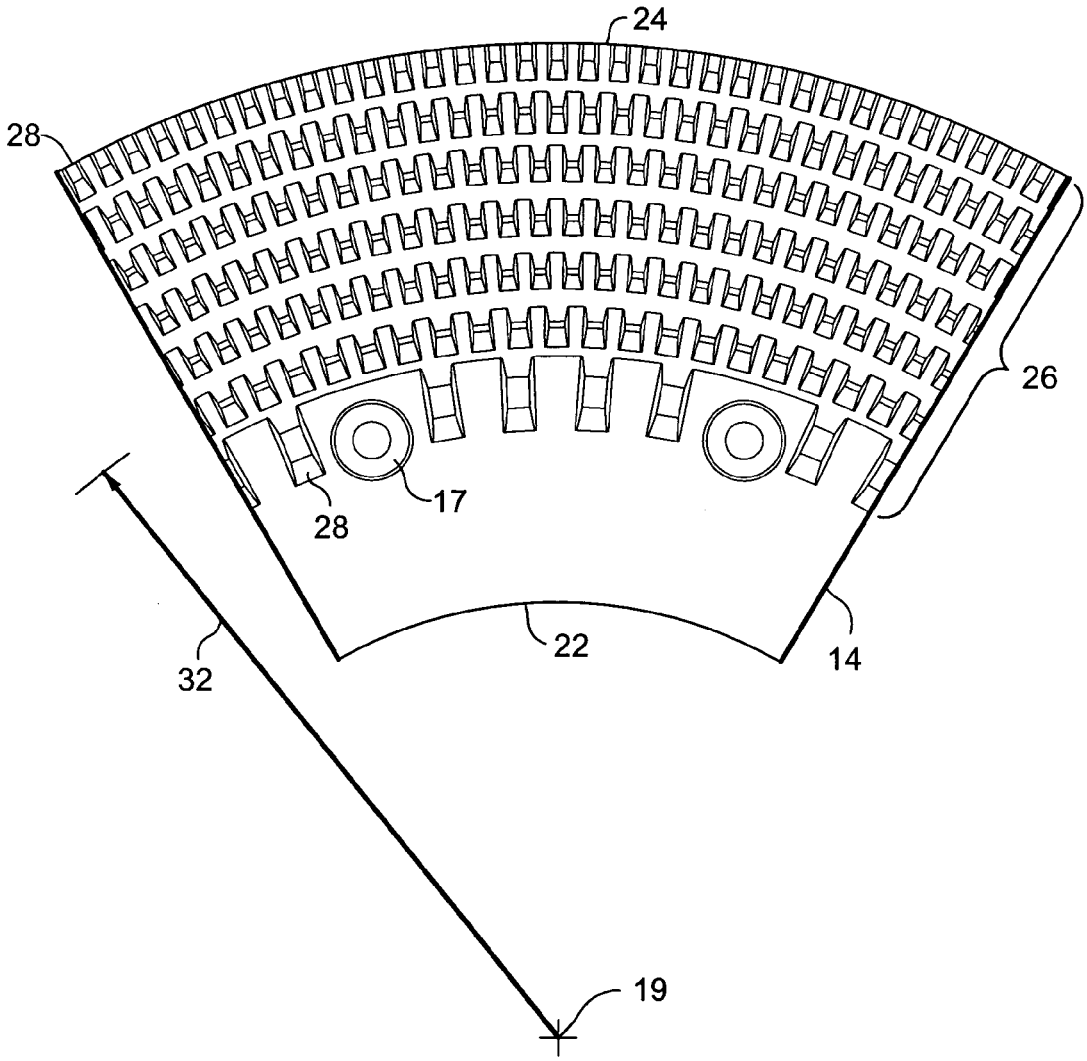
Fig. 1A (PRIOR ART)
FIGS. 1(*a*) and 1(*b*) are a front view and side cross-sectional view, respectively, of a toothed plate used in disc-type dispergers.
Figure 1C:
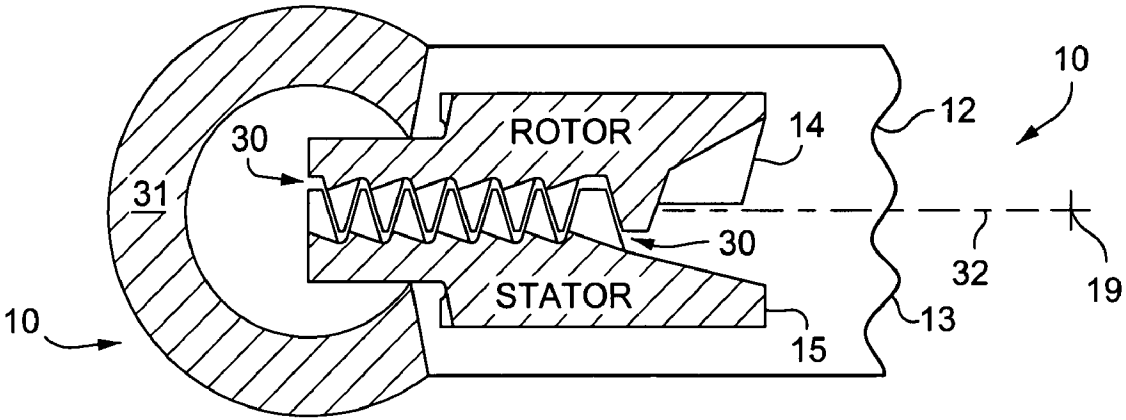
Fig. 1C (PRIOR ART)
Figure 1B:
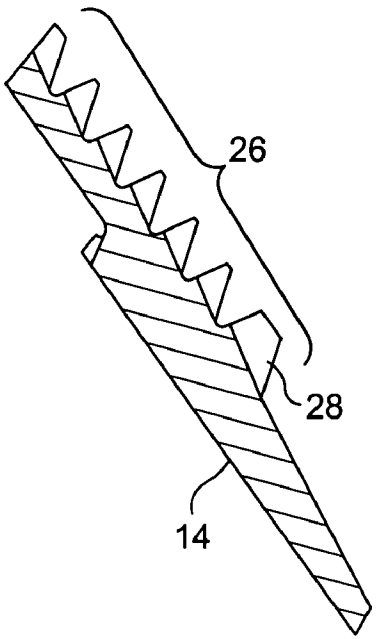
Fig. 1B (PRIOR ART)
Figure 2A:
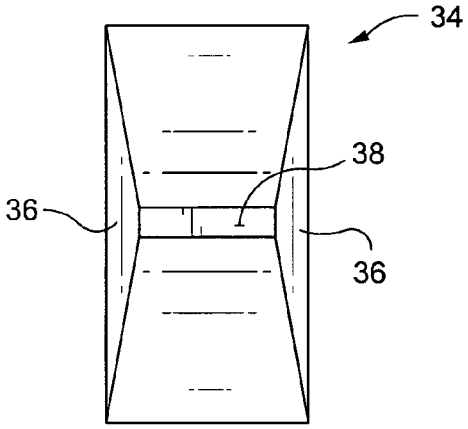
Fig. 2A (PRIOR ART)
FIGS. 2*a* and 2*b* are a top down view and a side perspective view, respectively, of a standard tooth geometry presently used in disperging, in which the tooth geometry comprises a pyramidal design having straight sidewalls that taper to the top of the tooth.
Figure 2B:
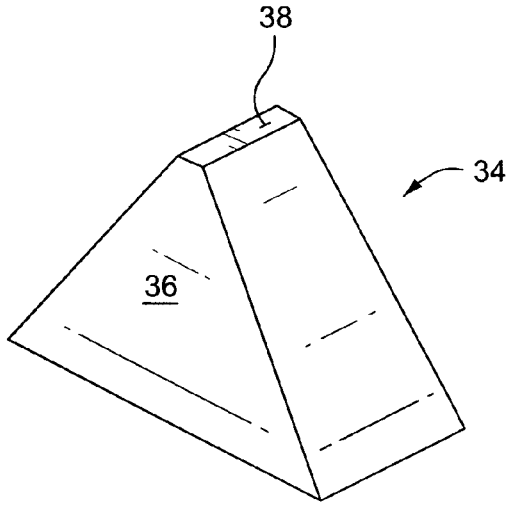
Fig. 2B (PRIOR ART)
Figure 3A:
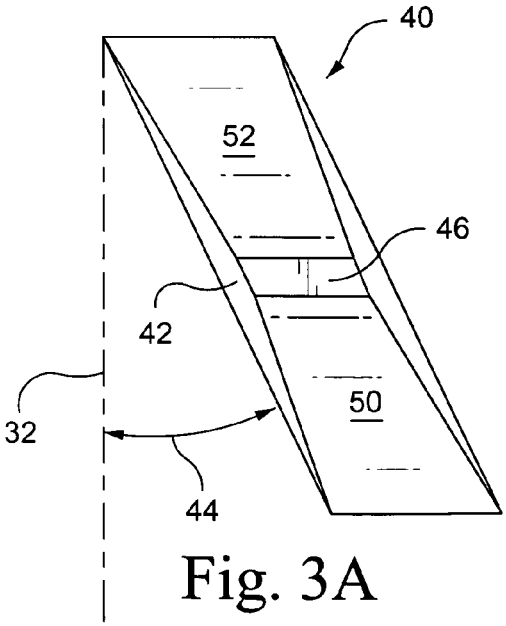
FIGS. 3*a* and 3*b* are a top down view and a side perspective view, respectively, of an angled tooth wherein the sidewalls of the tooth are angled with respect to a radius of the disc.
Figure 3B:
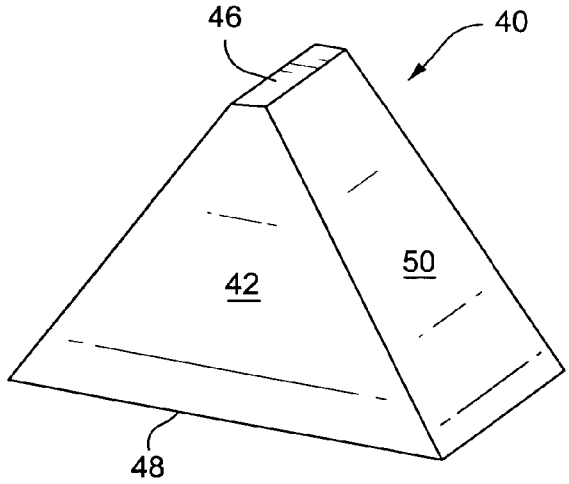

FIGS. 3*a* and 3*b* show a top view and a side perspective view, respectively, of an angled tooth 40 where the sides of the tooth are angled with respect to a radius 18 of the disc center. In particular, one or both of the sidewalls 42 of the tooth 40 form an angle 44 with respect to a radius 32 of the disc. Further, the sidewalls 42 may or may not taper towards the top 46 of the tooth. The base 48 of the tooth extends from a lower surface of the plate. The front 50 of the tooth faces radially inward and the rear 52 of the tooth faces radially outward. The front and rear faces may each be substantially parallel to a tangent to the plate. The front and rear faces may slope towards the top of the tooth.

In a preferred embodiment, both the rotor and stator plate segments have the novel arrangements of angled teeth and are used together. On the other hand, the rotor and stator design each provide improvements in their own right and can be used with other types of stator and rotor plate segments.

The geometry of the teeth for the disperger plates includes an angled design of the teeth sidewalls to facilitate control of the feed and retention of the pulp. The sidewall angle is the angle between a sidewall of a tooth and a radius of the plate/disc. The sidewall angle may be the same for all teeth in an annular row of teeth. The sidewall angle may vary between the rows of a plate. For example, the sidewall angle of the teeth in the first row of teeth (at the entrance to the plates, or the inner diameter of the plate) may differ by at least 20° to 90° from the sidewall angle of the last row of teeth (at the periphery of the plates). The change in sidewall angle can occur just between two adjacent or non-adjacent rows, across a series of three or more rows (where the rows may or may not be sequential), or can be a gradual angular change from one row to the next across all rows of a plate. Preferably, the change of sidewall angles from the first to last row of teeth is of at least 15°, and no more than 90°, and is most preferably between 20° and 90°.

The change in the sidewall angle between rows of teeth should achieve one or more of the following goals. The goals are all intended to achieve a more consistent feeding effect of fibers through a disc-type refiner having tooth plates, and particularly to a disc-type disperger:

Goal 1. When throughput in the disperger is very high, there can be a difficulty in feeding the material, especially at the inlet of the disperger plate, where centrifugal feeding force is less (due to smaller radial location) and open area for flow of pulp is also more limited (due to a lesser circumferential cross-sectional area at smaller radial location). In such a case, the application of a significant feeding angle e.g., 30 degrees or greater, on the rows of teeth at or towards the inlet of the plates will allow to feed a higher amount of fiber without the necessity to remove a significant amount of teeth which would otherwise reduce the disperging efficiency. As the pulp moves outwards and the combination of centrifugal force and open area are moving in a direction as to help the feed, the feeding angle is gradually reduced, e.g., to a range of 30 to 5 degrees or less, to maintain a large enough accumulation of pulp in the interface between teeth in order to get good disperging efficiency.

Goal 2. When throughput in the disperger is very low, there may not be enough accumulation of pulp in the interface between the teeth to achieve good disperging efficiency. The addition of an increasing holdback angle on the teeth as the pulp reaches the outer rows of teeth will provide enough retention time for the pulp to produce a larger accumulation of fiber and provide good disperging efficiency. The holdback angle may be between 5 degrees to 20 degrees, and slants the outer row of teeth in a direction opposite to the slant of the inner rows of teeth. The slant of the teeth is the angle that the sidewalls form with radii of the disc. Holdback angles are not generally preferred in the inner rows (near the inlet) as a holdback angle can result in poor feeding into the channel between the discs of the disperger unit. One or more of the radially outer rows have teeth arranged with holdback angles. If multiple rows, e.g., two to four, have holdback angles, the slope of the angle can gradually increase from one outer row to the next outermost row.

Goal 3. When fiber feed throughput is in a normal range, the tooth design can again benefit from slanted sidewall angles by using a slight feeding angle at the inlet and gradually reducing the slant from one row to the next outer row until the outermost row(s) have a slight holdback angle. The slight feeding angle may be in range of 45 degrees to 20 degrees and applied to the first, second and/or third innermost rows of teeth. The slight inlet feed angle and gradual change in sidewall angle from row to row should facilitate a more constant velocity of the pulp through the channels forming the disperging zone, and thus obtain a more consistent disperging effect between each tooth interface.

Figure 4A:
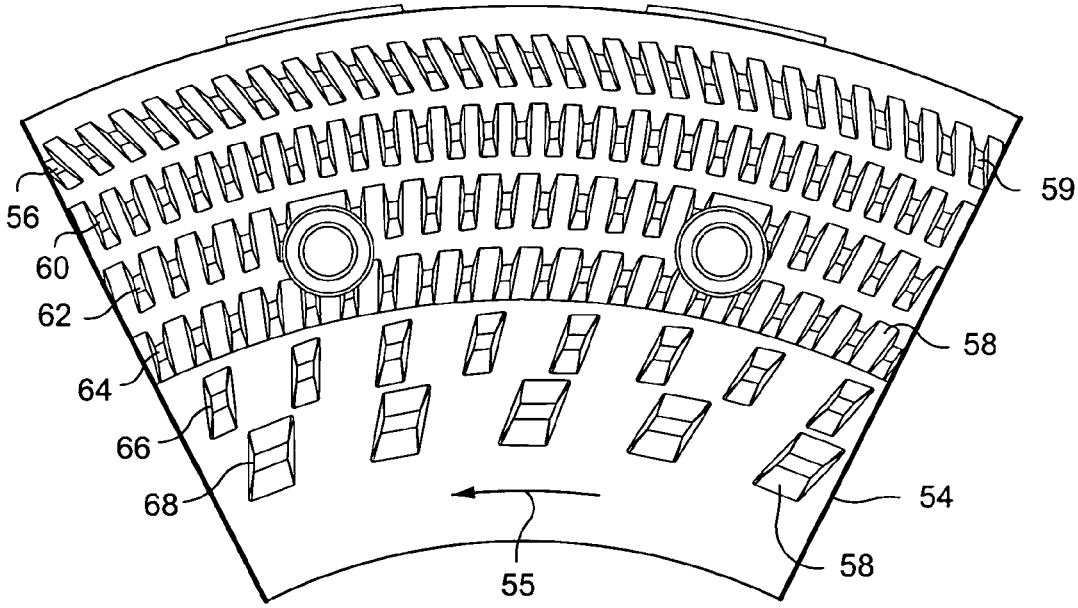
FIGS. 4*a* and 4*b* are a front plan view and a side cross-sectional view, respectively, of a disperging rotor plate utilizing an angled tooth geometry.
Figure 4B:
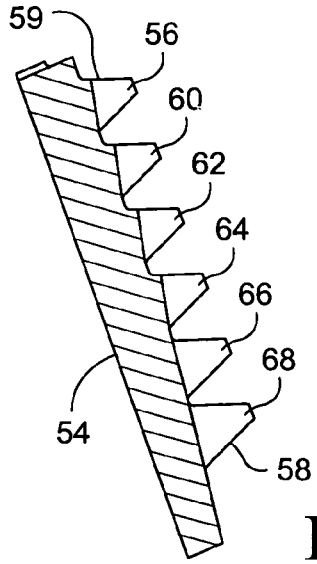
Figure 5A:
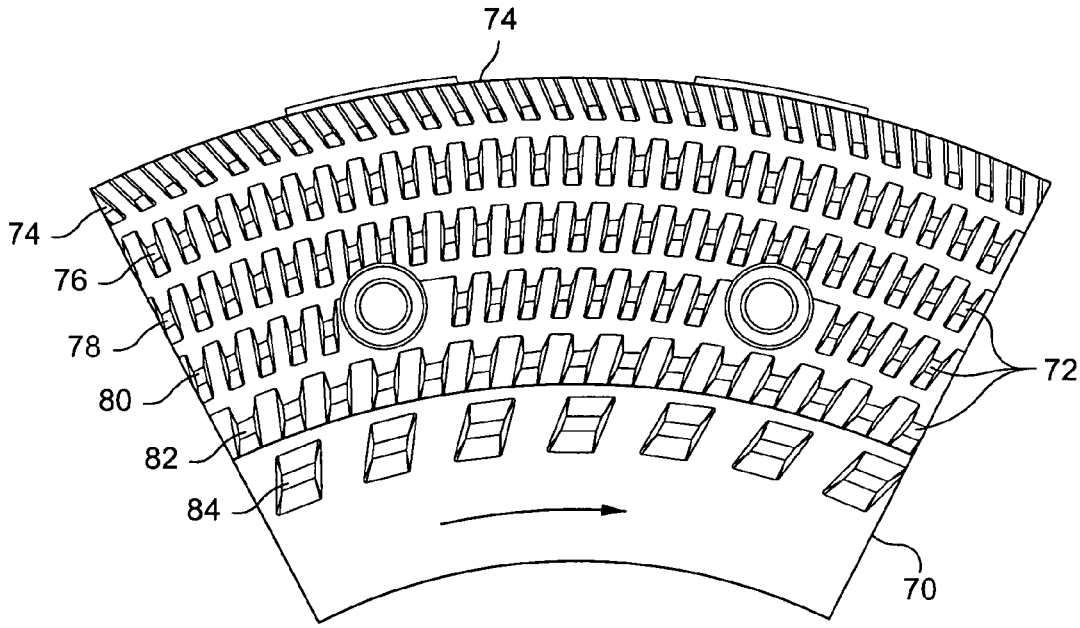
FIGS. 5*a* and 5*b* are a front plan view and a side cross-sectional view, respectively, of a disperging stator plate for use with the rotor plate shown in FIGS. 4*a* and 4*b*.
Figure 5B:
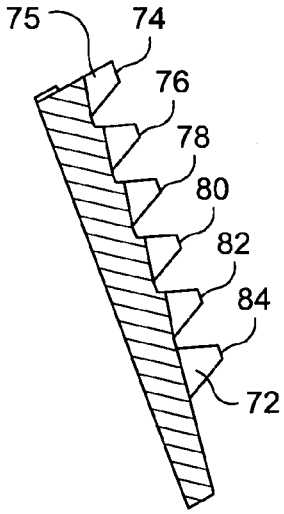

FIGS. 4*a* and 4*b* are a front plan view and a side-cross-sectional view, respectively, of an exemplary rotor disperger plate 54 employing a double angle geometry tooth that mates with the rotor plate displayed in FIGS. 5*a* and 5*b*. The rotational direction for the rotor plate counter-clockwise, as is indicated by arrow 55.

The rotor disperger plate segment 54 includes rows of teeth each having an angled sidewall tooth geometry. The sidewall angles gradually reduce from one row to the next outer row, until the outermost row 56 that has a holdback angle.

The angle of the sidewalls of the teeth 58 of the inner rows may change from row to row (see rows 58, 60, 62, 64, 66 and 68 in FIGS. 4*b* and 4*b*). The sidewall angle change may be incremental from row to row, alternate between large angular changes between adjacent rows and no change between rows, or be concentrated at the inlet rows (e.g., rows 64, 66 and 68) and the outer rows (e.g., rows 60 and 62). The change in sidewall angles between adjacent rows may be relatively small, such as 2° to 15°, especially if the sidewall angle change is incremental across all rows. The total change in the sidewall angles across all row is preferably at least 20° and no more than 90°. The change in angles from the inner row 68 to the outermost row 56 is more preferably in a narrow range of 20 degrees to 90 degrees.

For example, the innermost rows 68, 66 and 64 of teeth may have a sidewall angles of between 10° to 15°, the middle rows 62, 60 may both have the same sidewall angle of between 0° to 5°, and the outer row 56 may have a reverse (holdback) angle of 5° to 20°. Alternatively, the sidewall angles may gradually reduce in increments of 3° to 8° from a slight feed angle of 15° at the inlet rows (68, 66 and/or 64), to at or near zero sidewall angle for the teeth at row 60, and change rather dramatically to a reverse angle of less than a 20 degrees for the teeth in the holdback row 56.

FIGS. 5(*a*) and 5(*b*) show an exemplary stator disperger plate segment 70 employing the angle geometry teeth 72 arranged in rows 74, 76, 78, 80, 82 and 84. The stator disperger plate segment (when arranged in a plate) is intended to be opposite the rotor plate 54 such that the respective rows of the rotor and stator plates intermesh. The holdback angle (reverse to the sidewall angle of the inner rows) may be at least as great as the holdback angle of rotor row 56.

Figure 6A:
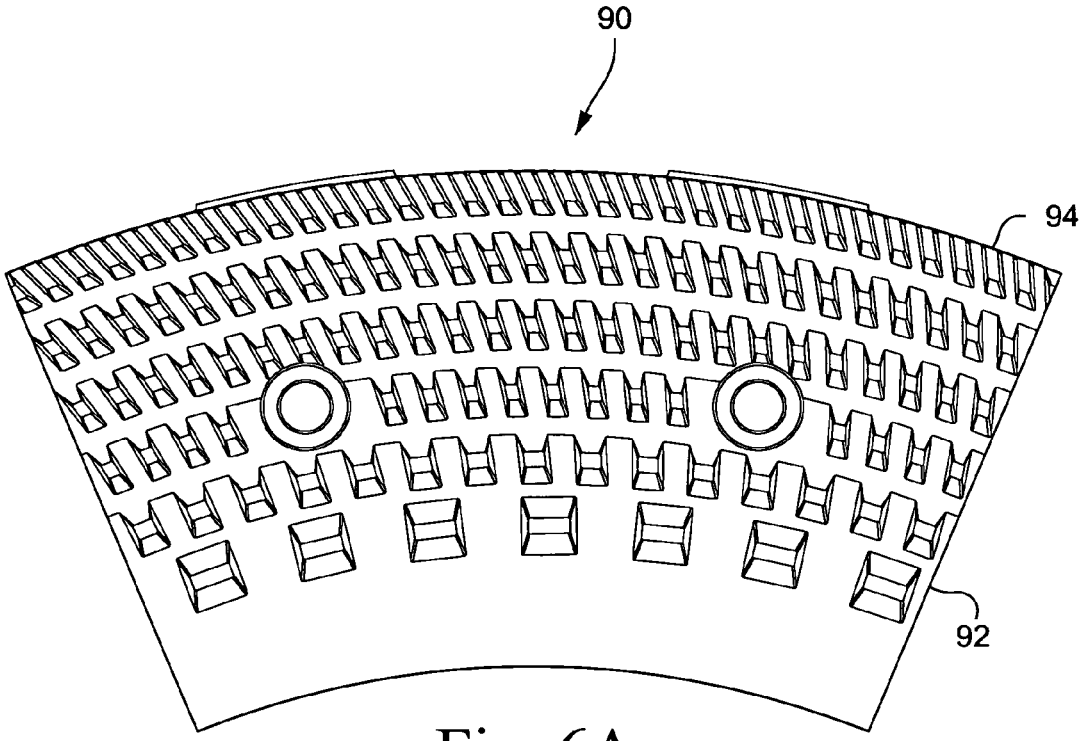
FIGS. 6*a* and 6*b* are a front plan view and a side cross-sectional view, respectively, of another embodiment of a disperging plate.
Figure 6B:
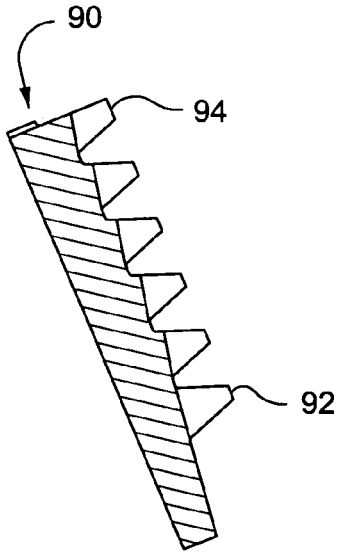

FIGS. 6(*a*) and 6(*b*) show an exemplary stator plate segment 90 having rows of teeth. In an inner row 92, the teeth form an angle in a range of 10 degrees to 20 degrees with respect to radial lines of the plate. The inner row may be an innermost row of teeth or one of the first two or three inner teeth rows. An outer row 94 of teeth may have a holdback angle of minus 10 to minus 60 degrees. The outer row 94 may be the outermost row of teeth or one of the two or three outermost teeth rows. Alternatively, the inner row of teeth 92 may form an angle in a range of 25 degrees to 35 degrees with respect to radial lines of the plate and the outer row 94 of teeth form a holdback angle of 5 degrees to minus 5 degrees.

Figure 7A:
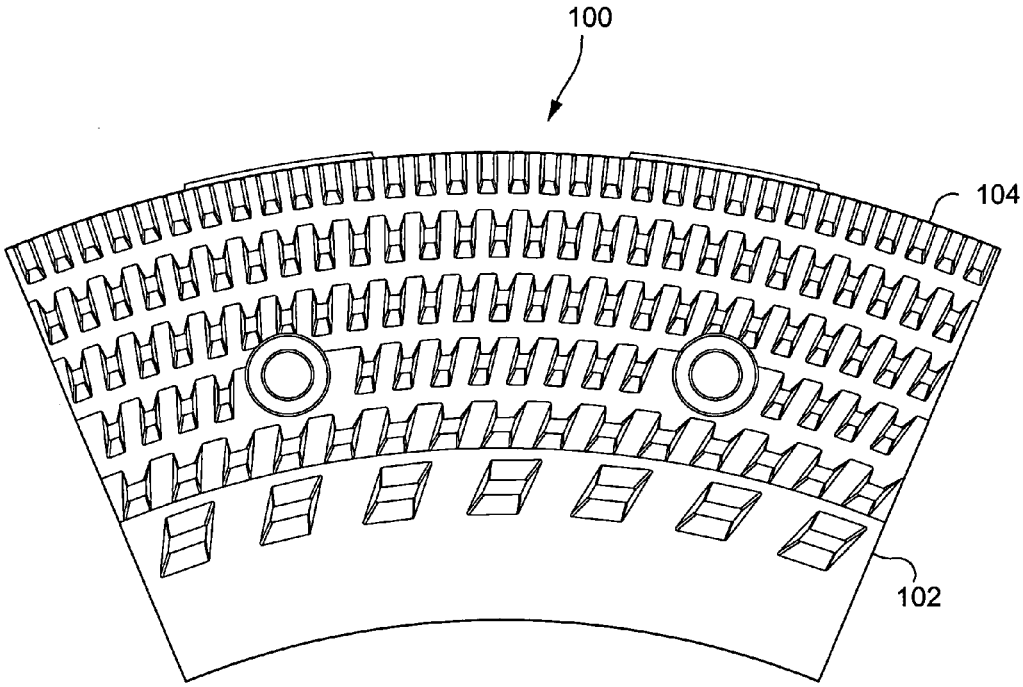
FIGS. 7*a* and 7*b* are a front plan view and a side cross-sectional view, respectively, of a further embodiment of a disperging plate.
Figure 7B:
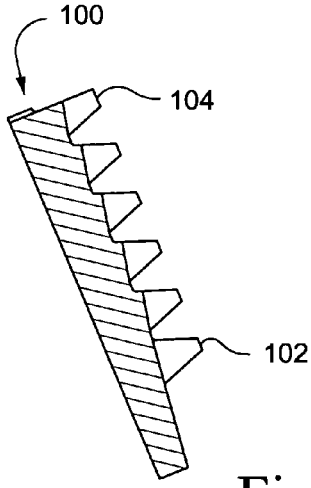

FIGS. 7*a* and 7*b* are a front plan view and a side cross-sectional view, respectively, of a further embodiment of a disperging plate 100. The inner row(s) 102 of teeth may form an angle in a range of 10 degrees to 20 degrees with respect to radial lines of the plate and the outer row(s) 104 of teeth may form a holdback angle of minus 10 degrees to minus 20 degrees. In a further alternative, the inner row 102 of teeth may form an angle in a range of 5 degrees to minus 5 degrees with respect to radial lines of the plate and the outer row 94 of teeth form a holdback angle of minus 25 degrees to minus 35 degrees (note that the term "holdback" angle refers to a backward (minus degrees) slant of the teeth).

The design of angled disperger teeth and the pattern of teeth on a disperger plate may be configured in various ways. For example, a plate pattern may include straight (0°) inlet teeth which are widely spaced and feeding teeth that gradually turn to holdback. The first of teeth in FIGS. 7*a* and 7*b* may have straight inlet teeth and the second row of teeth (which is an inner row) may have a feed angle of 10 to 20 degrees, or 5 degrees to minus 5 degrees. In addition, the angle of the disperger teeth could slightly increase or decrease between adjacent rows while still achieving a gradual variation in the angle of the teeth across all teeth rows.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A refiner plate comprising:

concentric rows of teeth, wherein each tooth in the rows is a pyramidal projection on the plate having sloped front and rear surfaces form a tooth top surface, the top surface having a width extending generally perpendicular to a radius of the plate extending through the tooth;

a feed angle formed on teeth in a plurality of rows, wherein the feed angle is formed by a leading edge of the tooth; and a feed angle for a first row of teeth differs from a second feed angle for a second row of teeth, wherein the second row of teeth are one of an outer four rows of teeth on the plate, the second row of teeth have a feed angle of at least 5 degrees, and the difference between feed angles is at least 20 degrees, wherein the concentric rows of teeth on the refiner plate interleave with concentric rows of teeth on an opposing refiner plate in a refiner.

2. The refiner plate of claim 1 wherein at least three rows teeth each have a unique feed angle that differs from feed angles in other rows of teeth.

3. The refiner plate of claim 1 wherein the difference is in a range of 30 to 90 degrees.

4. The refiner plate of claim 1 wherein the first row of teeth is a radially innermost row of teeth and the second row of teeth is a radially outermost row of teeth.

5. The refiner plate of claim 4 wherein the first row of teeth form an angle in a range of 60 degrees to 20 degrees with respect to radial lines of the plate.

6. The refiner plate of claim 4 wherein the first row of teeth form an angle in a range of 5 degrees to minus 5 degrees with respect to radial lines of the plate.

7. The refiner plate of claim 4 wherein the first row of teeth form an angle in a range of 5 degrees to 10 degrees with respect to radial lines of the plate, an outer row of teeth having an angle of minus 10 to minus 60 degrees, and a middle row of teeth between the first row an outer row form an angle in a range of minus 5 to positive 5, wherein the first, middle and outer rows each have a different angle.

8. The refiner plate of claim 7 wherein the angle varies from row to row.

9. The refiner plate of claim 7 wherein the angles between adjacent rows of teeth vary between 2 degrees and 10 degrees for all rows on the plate.

10. The refiner plate of claim 4 wherein the first row of teeth form a feed angle in a range of 25 degrees to 35 degrees with respect to radial lines of the plate, an outer row of teeth having an angle of 5 degrees to minus 5 degrees, and a middle row of teeth between the first row an outer row form an angle in a range of 5 to 20 degrees, wherein the first, middle and outer rows each have a different angle.

11. The refiner plate of claim 4 wherein the first row of teeth form a feed angle in a range of 10 degrees to 20 degrees with respect to radial lines of the plate, an outer row of teeth having an angle of minus 10 degrees to minus 20 degrees, and a middle row of teeth between the first row an outer row form an angle in a range of a minus 5 degrees to positive 5 degrees angle, wherein the first, middle and outer rows each have a different angle.

12. The refiner plate of claim 4 wherein the first row of teeth form an angle in a range of 5 degrees to minus 5 degrees with respect to radial lines of the plate and an outer row of teeth having an angle of minus 25 degrees to minus 35 degrees.

13. The refiner plate of claim 1 wherein a first group of rows of teeth have the same angle as does the first row, a second group of rows of teeth have the same feed angle as does the second row, and a third group of rows of teeth have a third feed angle, wherein the third feed angle is intermediate the first and second feed angles.

14. The refiner plate of claim 13 wherein the first group of rows are radially inward of the third group, and the second group is radially inward of the third group.

15. The refiner plate of claim 1 wherein the plate comprises an annular array of plate segments.

16. A refiner comprising:

a rotor disc including a rotor plate and a stator disc including a stator plate wherein the stator plate is opposite to and faces the rotating rotor plate;

the rotor plate includes concentric rows of teeth, and a feed angle for a first row of teeth of the rotor plate differs from a second feed angle for a second row of teeth, and a third feed angle which differs from the feed angles for the first and second rows and the third row is intermediate the first and second rows, wherein the second row of teeth in the stator plate are one of an outer four rows of teeth on the plate, the second row of teeth in the stator plate have a feed angle of at least 5 degrees, and the difference between the feed angles for the first and second rows is in a range of 20 to 90 degrees, and the stator plate includes concentric rows of teeth, and a feed angle for a first row of teeth of the stator plate differs from a second feed angle for a second row of teeth, and a third feed angle which differs from the feed angles for the first and second rows and the third row is intermediate the first and second rows, wherein the difference between the feed angles for the first and second rows is in a range of 20 to 90 degree, wherein the concentric rows of teeth on the stator plate interleave with the concentric rows of teeth on the rotor plate.

17. The refiner of claim 16 wherein the differences in angles for the first and second rows are a range of 30 to 90 degrees.

18. The refiner of claim 16 wherein the first row of teeth is a radially innermost row of teeth and the second row of teeth is a radially outermost row of teeth.

19. The refiner of claim 16 wherein the first row of teeth form an angle in a range of 5 degrees to minus 5 degrees with respect to radial lines of the plate.

20. The refiner plate of claim 16 wherein the first row of teeth form an angle in a range of 5 degrees to minus 5 degrees with respect to radial lines of the plate.

21. The refiner plate of claim 16 wherein the first row of teeth form an angle in a range of 10 degrees to 20 degrees with respect to radial lines of the plate and an outer row of teeth having an angle of minus 10 to minus 60 degrees.

22. The refiner plate of claim 16 wherein the first row of teeth form an angle in a range of 25 degrees to 35 degrees with respect to radial lines of the plate and an outer row of teeth having an angle of 5 degrees to minus 5 degrees.

23. The refiner plate of claim 16 wherein the first row of teeth form an angle in a range of 10 degrees to 20 degrees with respect to radial lines of the plate and an outer row of teeth having an angle of minus 10 degrees to minus 20 degrees.

24. The refiner plate of claim 16 wherein the first row of teeth form an angle in a range of 5 degrees to minus 5 degrees with respect to radial lines of the plate and an outer row of teeth having an angle of minus 25 degrees to minus 35 degrees.

* * * * *